United States Patent [19]

Schranz et al.

[11] Patent Number: 4,732,839

[45] Date of Patent: Mar. 22, 1988

[54] ALKALI METAL ALGINATE SURFACE LAYER FOR HEAT DEVELOPMENT PROCESS

[75] Inventors: Karl-Wilhelm Schranz, Odenthal-Hahnenberg; Günther Schenk, Cologne, both of Fed. Rep. of Germany

[73] Assignee: Agfa Gevaert Aktiengesellschaft, Leverkusen, Fed. Rep. of Germany

[21] Appl. No.: 902,151

[22] Filed: Aug. 29, 1986

[30] Foreign Application Priority Data

Sep. 10, 1985 [DE] Fed. Rep. of Germany ..... 3532141

[51] Int. Cl.[4] ..... G03C 5/54; G03C 1/90

[52] U.S. Cl. ..... 430/203; 430/215; 430/262

[58] Field of Search ..... 430/203, 215, 262

[56] References Cited

U.S. PATENT DOCUMENTS

| | | | |
|---|---|---|---|
| 3,220,835 | 11/1986 | Land | 430/262 |
| 3,730,718 | 5/1973 | Danhauser | 430/259 |
| 4,500,626 | 2/1985 | Naito et al. | 430/351 |
| 4,529,683 | 7/1985 | Bishop | 430/262 |
| 4,619,883 | 10/1986 | Aono et al. | 430/203 |
| 4,665,005 | 5/1987 | Aono et al. | 430/203 |

*Primary Examiner*—Richard L. Schilling

*Attorney, Agent, or Firm*—Connolly and Hutz

[57] ABSTRACT

Transfer images free from spots are obtained by the heat development process using a photographic recording material and a separate image receptor sheet if either the photothermographic recording material or the image receptor sheet or both contain a mixture of gelatine and sodium alginate in a surface contact layer.

6 Claims, No Drawings

ALKALI METAL ALGINATE SURFACE LAYER FOR HEAT DEVELOPMENT PROCESS

This invention relates to a heat development process in which a colour photographic recording material which has been exposed imagewise and which contains a layer of binder with silver halide and at least one colour providing compound on a common layer support, is heated in contact with an image receptor sheet and the image receptor sheet with the colour image produced therein is subsequently separated from the recording material.

It is known to produce colour images by heat treatment of suitable colour photographic recording materials. Colour providing compounds particularly suitable for this purpose are those which can be incorporated in a non-diffusible form in the layer of a photographic recording material and are capable of releasing a diffusible dye (dye releasing compound) as a result of development.

The special suitability of such dye releasing compounds is due to the fact that the dyes which have been released imagewise can be transferred to special image receptor layers to form a brilliant colour image which has no unwanted silver image or silver halide superimposed on it and therefore requires no after-treatment. The combination of heat development process with dye diffusion process thus provides an advantageous rapid process for the production of colour images. A recording material suitable for this purpose is described, for example, in DE-A-No. 3 215 485.

According to the above-mentioned prior publication, a recording material having a layer containing a combination of silver halide, silver benzotriazole, a dye releasing compound and guanidine trichloroacetate (base donor) is exposed imagewise and then subjected to a heat treatment in contact with an image receptor sheet so that the dye which has been released imagewise is transferred to the image receptor sheet. Several such combinations are necessary for producing multicoloured images, the silver halide in each of these combinations being sensitive to a different spectral region of light and being associated with a dye releasing compound conforming to its spectral sensitivity, this dye releasing compound releasing a dye of a different colour, in most cases a colour which is complementary to the colour of the light to which the particular silver halide is predominantly sensitive. Such associations may be arranged in different layers above one another.

Separation of the image receptor sheet from the light-sensitive part of the recording material proceeds smoothly in the usual dye diffusion transfer processes, i.e. when liquid or pasty treatment masses are used, but is difficult in heat development processes, especially when there is no access of moisture from outside. In such cases it is observed that the light-sensitive part and image receptor sheet tend to stick together at the higher temperatures of heat development. The layers can then only be separated by force, which generally damages the surfaces, or by soaking the material for some time in warm water, which vitiates the advantage of being able to carry out the heat development process as a rapid process. Furthermore, it is found to be difficult to establish complete and perfect surface contact between the light-sensitive part of the recording material and the image receptor sheet. The colour transfer image obtained frequently has numerous patches and irregularities in colour density which are an indication of imperfect contact between the materials.

It is an object of the present invention to improve the heat development process based on the dye diffusion process using a colour photographic recording material with separate image receptor sheet so that perfect colour transfer is achieved and the image receptor sheet can finally be smoothly separated from the colour photographic recording material without the aid of a treatment bath.

The present invention relates to a heat development process for the production of colour images in which an imagewise exposed colour photographic recording material having a layer support carrying at least one layer of binder containing light-sensitive silver halide, optionally in combination with a substantially light-insensitive silver salt, and at least one non-diffusible colour providing compound capable of releasing a diffusible dye as a result of development, is developed by heat treatment, and in which the dye released imagewise from the non-diffusible colour providing compound is transferred by heat treatment to an image receptor sheet which has its active side in surface contact with the recording material, said receptor sheet comprising a layer support carrying an image receptor layer capable of absorbing diffusible dyes, and the image receptor sheet is thereupon separated from the recording material, characterised in that either the light-sensitive recording material or the image receptor sheet or both contain an alkali metal alginate, in particular sodium alginate, in a surface contact layer.

The colour photographic recording material used in the process according to the invention carries, on a dimensionally stable layer support, at least one layer of binder containing a light-sensitive silver halide, optionally in combination with a substantially light-insensitive silver salt and a non-diffusible, colour providing compound capable of releasing a diffusible dye by heat development.

An essential constituent of the heat developable recording material is the silver halide which may consist of silver chloride, silver bromide, silver iodide or mixtures thereof and may have a particle size of from 0.01 to 2.0 $\mu$m, preferably from 0.1 to 1.0 $\mu$m. It may be present as non-sensitized silver halide or it may have been chemically and/or spectrally sensitized by suitable additives.

The quantity of light-sensitive silver halide may amount to 0.01 to 2.0 g per $m^2$ in each layer, the actual quantity in some embodiments being used mainly in the lower range of the above mentioned limits owing to its catalytic function (as exposed silver halide).

The substantially light-insensitive silver salt may be a silver salt which is comparatively stable to light, e.g. an organic silver salt. Suitable examples of such salts include the silver salts of aliphatic and aromatic carboxylic acids and the silver salts of heterocyclic compounds containing nitrogen, as well as silver salts of organic mercapto compounds.

The following are preferred examples of silver salts of aliphatic carboxylic acids: Silver behenate, silver stearate, silver oleate, silver laurate, silver caprate, silver myristate, silver palmitate, silver maleate, silver fumarate, silver tartrate, silver furoate, silver linolate, silver adipate, silver sebacate, silver succinate, silver acetate and silver butyrate. The carboxylic acids of these silver salts may be substituted, for example, by halogen atoms, hydroxyl groups or thioether groups.

The following are examples of silver salts of aromatic carboxylic acids and of other compounds containing carboxyl groups: Silver benzoate, silver -3,5-dihydroxybenzoate, silver-o-methylbenzoate, silver-m-methylbenzoate, silver-p-methylbenzoate, silver-2,4-dichlorobenzoate, silver acetamidobenzoate, silver gallate, silver tannate, silver phthalate, silver terephthalate, silver salicylate, silver phenyl acetate, silver pyromellitate and silver salts of 3-carboxymethyl-4-methyl-4-thiazolin-2-thione and similar heterocyclic compounds. Silver salts of organic mercaptans are also suitable e.g. the silver salts of 3-mercapto-4-phenyl-1,2,4-triaxole, 2-mercaptobenzimidazole, 2-mercapto-benzothiazole, 2-mercaptobenzoxazole, 2-mercaptooxadiazole, mercaptotriazine and thioglycollic acid, and the silver salts of dithiocarboxylic acids, e.g. the silver salt of dithioacetate.

The silver salts of compounds containing an imino group are also suitable. Preferred examples of such compounds include the silver salts of benzotriazole and its derivatives, e.g. the silver salts of alkyl- and/or halogen-substituted benzotriazoles, such as the silver salts of methylbenzotriazole or of 5-chlorobenzotriazole or the silver salts of 1,2,4-triazole, 1-H-tetrazole, carbazole or saccharin and the silver salts of imidazole and derivatives thereof.

The quantity of substantially light-insensitive silver salts to be applied according to the invention is in the range of 0.05 to 5 g per $m^2$ for each layer. The substantially light-insensitive silver salt and the light-sensitive silver halide may be present side by side as separate particles or they may be present in a combined form which may be produced, for example, by treating a substantially light-insensitive silver salt in the presence of halide ions so that light-sensitive centres of light-sensitive silver halide form on the surfaces of the particles of substantially light-insensitive silver salt by double conversion. See U.S. patent application Ser. No. 3,457,075.

The substantially light-insensitive silver salt serves as reservoir for metal ions which are reduced to elementary silver under the catalytic influence of imagewise exposed silver halide when heat treatment takes place in the presence of a reducing agent and then serve as oxidizing agent (for the reducing agent present).

Another essential constituent of the recording material according to the invention is a non-diffusible colour providing compound which is capable of releasing a diffusible dye as a result of the redox reaction which takes place in the course of development, this compound being referred to hereinafter as dye releasing compound.

The dye releasing compounds used according to the invention may be any of numerous types of compounds which are all distinguished by a linking member, the binding strength of which is redox dependent and which links the dye residue with a carrier group containing a ballast group.

See in this connection a summary of the subject matter in Angew. Chemie Int. Ed. Engl. 22 (1983), 191–209, in which the most important of the known systems are described.

Redox active dye releasing compounds of the formula

BALLAST—REDOX—DYE are found to be particularly advantageous. In the above formula, BALLAST denotes a ballast group, REDOX denotes a redox active group, i.e. group which is capable of being oxidized or reduced under the conditions of alkaline development and which, depending on whether it is present in the oxidized or reduced state, undergoes to varying extents an elimination reaction, a nucleophilic displacement reaction, hydrolysis or some other decomposition reaction as a result of which the DYE group is split off, and DYE denotes the residue of a diffusible dye, e.g. a yellow, magenta or cyan dye or the residue of a dye precursor.

Groups which enable the dye releasing compounds according to the invention to be incorporated in a diffusion-fast form in the hydrophilic colloids conventionally used in photographic materials may be regarded as ballast groups. Particularly suitable for this purpose are organic groups generally containing straight chained or branched aliphatic groups with, generally, 8 to 20 carbon atoms and optionally also carbocyclic or heterocyclic, optionally aromatic groups. These groups are connected to the remaining part of the molecule either directly or indirectly, e.g. through one of the following groups: NHCO, $NHSO_2$, NR wherein R denotes hydrogen or alkyl, O or S. The ballast group may in addition contain water-solubilizing groups, e.g. sulpho groups or carboxyl groups, and these may be present in an anionic form. Since the diffusion characteristics depend on the molecular size of the whole compound used, it is in some cases sufficient, e.g. if the molecule as a whole is sufficiently large, to use only short chained groups as ballast groups.

Redox active carrier groups having the structure BALLAST-REDOX-dye releasing compound are known in various forms. A detailed description need not be given here in view of the summary given in the article in Angew. Chem. Int. Ed. Engl. 22 (1983) 191–209.

Some examples of redox active carrier groups from which a dye residue is split off as a result of imagewise oxidation or reduction are given below merely for the purpose of illustration:

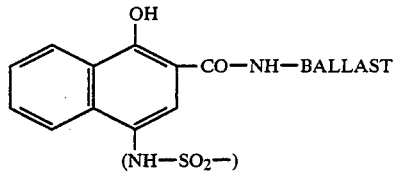

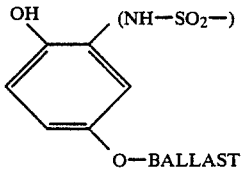

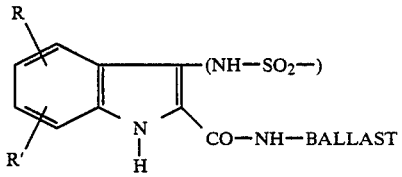

-continued

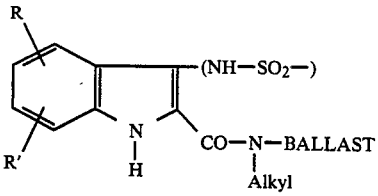

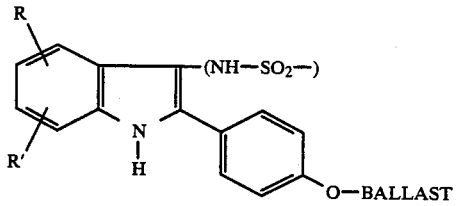

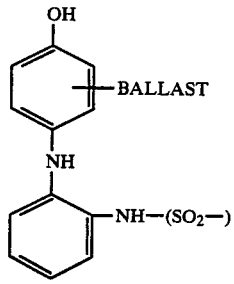

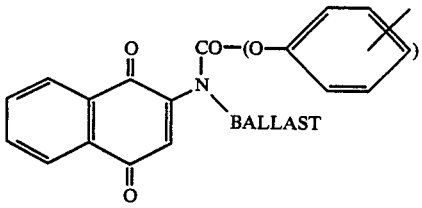

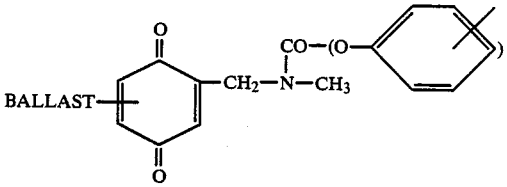

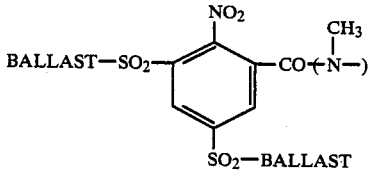

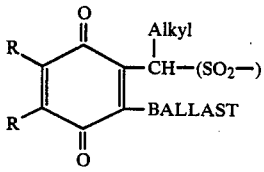

-continued

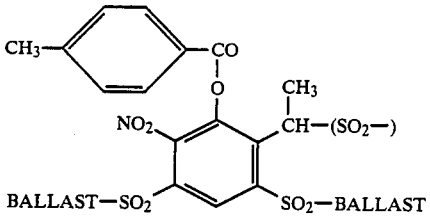

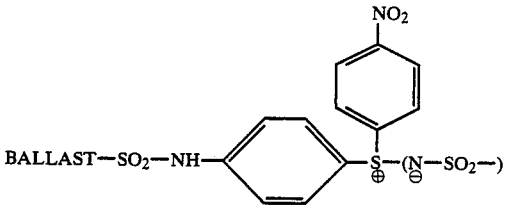

The groups in brackets are functional groups of the dye residue and are separated together with this residue from the remaining part of the carrier group. The functional group may be a substituent which may have a direct influence on the absorption and possibly also complex forming properties of the released dye. On the other hand, the functional group may be separated from the chromophore of the dye by an intermediate or connecting link. Lastly, the functional group may have some influence, possibly together with the intermediate link, on the diffusion and mordanting characteristics of the released dye. Alkylene and arylene groups, for example, are suitable intermediate links.

Dye residues from all classes of dyes are suitable, provided they are sufficiently diffusible to be able to diffuse from the light-sensitive layer of the light-sensitive material into an image receptor layer. The dye residues may be equipped with one or more alkali solubilizing groups for this purpose. Such groups which are capable of providing solubility in alkalies include carboxyl groups, sulpho groups, sulphonamide groups and aromatic hydroxyl groups. These alkali solubilizing groups may already be preformed in the dye releasing compounds or they may result from the dye residue being split off the carrier group which contains ballast groups. The following are suitable dyes: Azo dyes, azomethine dyes, anthraquinone dyes, phthalocyanine dyes, indigoid dyes and triphenylmethane dyes, including dyes which have undergone or are capable of undergoing complex formation with metal ions.

Residues of dye precursors are understood to be residues of compounds which are converted into dyes in the course of photographic processing, in particular under the conditions of heat development, either by oxidation or by coupling or by complex formation or by exposure of an auxochromic group in a chromophoric system, for example by saponification. Dye precursors in this sense may be leuco dyes, couplers or dyes which are converted into other dyes in the course of processing. Where a distinction between dye residues and residues of dye precursors is not important, the term dye residue is to be understood also to include residue of dye precursors.

Suitable dye releasing compounds are described, for example, in the following: U.S. patent application Ser. No. 3,227,550, U.S. patent application Ser. No. 3,443,939, U.S. patent application Ser. No. 3,443,940, DE-A- No. 1 930 215, DE-A- No. 2 242 762, DE-A- No.

2 402 900, DE-A- No. 2 406 664, DE-A- No. 2 505 248, DE-A- No. 2 543 902, DE-A- No. 2 613 005, DE-A- No. 2 645 656, DE-A- No. 2 809 716, DE-A- No. 2 823 159, BE-A- No. 861 241, EP-A- No. 0 004 399, EP-A- No. 0 004 400, DE-A- No. 3 008 588, DE-A- No. 3 014 669 and GB-A- No. 8 012 242.

In some embodiments of the heat development process according to the invention, the dye releasing compounds may be present in an oxidizable form or capable of coupling, and in others they may be present in a reducible form. When conventional negative silver halide emulsions are used, the copy obtained from the original will be either a negative or a positive, depending on whether the dye is released from the oxidized or the reduced form of dye releasing compound. Positive or negative images can therefore be obtained as desired by suitable choice of the dye releasing system.

Oxidizable dye releasing compounds particularly suitable for the heat developable recording materials according to the invention are described, for example, in DE-A-No. 2 242 762, DE-A- No. 2 505 248, DE-A-No. 2 613 005, DE-A-No. 2 645 656 and GB-A- No. 8 012 242.

If the dye releasing compound is oxidizable, it constitutes a reducing agent which is oxidized directly or indirectly by the action of electron transfer agents (ETA) by the imagewise exposed silver halide or by the substantially light-insensitive silver salt under the catalytic action of the imagewise exposed silver halide. Imagewise differentiation then takes place according to the capacity to release the diffusible dye. If, on the other hand, the dye releasing compound is reducible, then it is advantageously used in combination with a limited quantity of reducing agent, a so-called electron donor compound or an electron donor precursor compound, which in this case is present in the same layer of binder as the dye releasing compound, the light-sensitive silver halide and any substantially light-insensitive silver salt used. The presence of electron transfer agents may also be advantageous when reducible dye releasing compounds are used in combination with electron donor compounds.

For producing positive colour images from positive originals when negative silver halide emulsions are used, it is suitable, for example, to use a recording material according to the invention containing reducible dye releasing compounds containing a carrier group of the following formula:

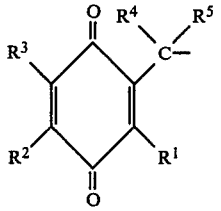

"Carquin"

wherein $R^1$ denotes alkyl or aryl.

$R^2$ denotes alkyl, aryl or a group which together with $R^3$ completes a condensed ring, $R^3$ denotes hydrogen alkyl, aryl, hydroxyl, halogen such as chlorine or bromine, amino, alkylamino, dialkylamino including cyclic amino groups (such as piperidino and morpholino), acylamino, alkylthio, alkoxy, aroxy, sulpho or a group which together with $R^2$ completes a condensed ring.

$R^4$ denotes alkyl, and $R^5$ denotes alkyl or, preferably, hydrogen, and at least one of the groups $R^1$ to $R^4$ contains a ballast group.

Reducible dye releasing compounds of this kind and others which are also suitable for the purpose of the present invention are described, for example, in DE-A-No. 2 809 716, EP-A- No. 0 004 399, DE-A- No. 3 008 588 and DE-A- No. 3 014 669.

The electron donor compound used in combination with a reducible dye releasing compound also serves as reducing agent for the silver halide, the substantially light-insensitive silver salt and the dye releasing compound. Since the substantially light-insensitive silver salt and the dye releasing compound to some extent compete with each other in the oxidation of the electron donor compound and the former is superior to the latter, at least in the presence of exposed silver halide, the silver halide present determines, according to a preceding imagewise exposure, the image areas in which the dye releasing compound is converted into its reduced form by the electron donor compound.

Under the conditions of development, in the present case when the imagewise exposed colour photographic recording material is heated in contact with the auxiliary sheet used according to the invention, the electron donor compound which is present in a limited quantity is oxidized, to an extent depending on the previous exposure, by the substantially light-insensitive silver salt and the light-sensitive silver halide under the catalytic action of the latent image nuclei formed in the silver halide by exposure, and is therefore no longer available for a reaction with the dye releasing compound. An imagewise distribution of unused electron donor compound therefore takes place.

Compounds which have been described as electron donor compounds include, for example, non-diffusible or only slightly diffusible derivatives of hydroquinone, of benzisoxazolone, of p-aminophenol and of ascorbic acid (e.g. ascorbyl palmitate) (DE-A-No. 2 809 716).

Other examples of electron donor compounds are disclosed in DE-A- No. 2 947 425, DE-A- No. 3 006 268, DE-A- No. 3 130 842, DE-A- No. 3 144 037, DE-A- No. 3 217 877, DP-A No. 0 124 915 and Research Disclosure 24305 (July 1984). It has been found that the above mentioned electron donor compounds satisfy the specified requirements under the conditions of heat development and are therefore also suitable as electron donor compounds for the purpose of the present invention.

Particularly suitable are those electron donor compounds which are only formed in the layer from the corresponding electron donor precursor compounds under the conditions of heat development, i.e. electron donor compounds which before development only exist in a virtually inactive, masked form in the recording material. These initially inactive electron donor compounds are then converted into their active form under the conditions of heat development, for example by the removal of certain protective groups by hydrolysis. In the present case, the above mentioned electron donor precursor compounds are also regarded as electron donor compounds.

The above mentioned major constituents of the recording material used in the process according to the invention, namely the light-sensitive silver halide, the substantially light-insensitive, reducible silver salt optionally present, and the dye releasing compound, optionally in combination with an electron donor compound, are present side by side dispersed in a binder which may be hydrophobic or hydrophilic but is preferably hydrophilic and the substance preferably used is gelatine which may, however, be partly or completely replaced by other natural or synthetic binders.

For the production of monochrome colour images, one or more dye releasing compounds which release dyes of a particular colour are associated with the light-sensitive silver halide and optionally light-insensitive silver salt in the light-sensitive layer of binder. The resulting overall colour can be obtained by mixing several dyes. It is thereby also possible to produce black-and-white images from an accurately adjusted mixture of several dye releasing compounds producing dyes of different colours. For the production of multicolour images, the colour photographic recording material used for the process according to the invention contains several, i.e. generally three associations of dye releasing compounds with silver halides which are sensitized to different regions of the spectrum, the region of absorption of the dye released from the dye releasing compound preferably corresponding substantially to the region of spectral sensitivity of the associated silver halide. The different associations of dye releasing compounds and silver halide may be accommodated in different layers of binder in the colour photographic recording material. Separating layers consisting of a water-permeable binder, e.g. gelatine, are preferably provided between these different layers of binder, mainly for the purpose of separating the different associations from one another to counteract falsification of the colour. In one such case, the colour photographic recording material used according to the invention contains, for example, a light-sensitive layer of binder in which the silver halide is predominantly sensitive to red as a result of spectral sensitization, another light-sensitive layer of binder in which the silver halide has been rendered predominantly sensitive to green by spectral sensitization and a third light-sensitive layer of binder in which the silver halide is predominantly sensitive to blue either due to its own sensitivity or as a result of spectral sensitization. The electron donor compounds optionally present in the three light-sensitive layers may be identical or different.

Each of the above mentioned associations of light sensitive silver halide, substantially light-insensitive silver salt (if present) and dye releasing compound may also be present in the form of a so-called complex coacervate.

A complex coacervate is a form of dispersion in which a mixture of the main constituents is enclosed in a common shell of hardened binder. Dispersions of this kind are also referred to as packet emulsions and are obtained by complex coacervation.

The term "complex coacervation" is used to denote the occurrence of two phases when an aqueous solution of a polycationic colloid is mixed with that of a polyanionic colloid to form a concentrated colloid phase (hereinafter referred to as complex coacervate) and a dilute colloid phase (hereinafter referred to as equilibrium solution) as a result of electric interaction. The complex coacervate separates from the equilibrium solution in the form of droplets and appears as a white cloudiness. When complex coacervation is carried out in the presence of a solid such as silver halide or fine oil droplets, it is generally assumed that the complex coacervate encloses the solid or droplets in the interior of colloid particles. This results in a dispersion of coacervate particles in which the solid (in the present case the light-sensitive silver halide and, if present, the substantially light-insensitive silver salt) and oily droplets of a solution of the organic constituents (in the present case the dye releasing compound and optionally other auxiliary substances) are enclosed. The material is subsequently hardened with a hardener so that the original form of the particles is not destroyed in the subsequent stages of preparation of the photographic recording material such as preparation of the casting solution and coating. A packet emulsion of good quality is obtained if the dispersion is cooled before hardening to a temperature of 25° C. or below, preferably 10° C. or below.

Methods for the preparation of a packet emulsion in which a colour forming substance is incorporated by complex coacervation are described, for example, in U.S. patent application Ser. No. 3 276 869 and U.S. patent application Ser. No. 3,396,026.

The use of packet emulsions enables several emulsion components differing in their spectral sensitivity as well as the corresponding dye releasing compounds to be brought together in a single layer of binder without any loss in the spectral association which would result in colour falsification. This is possible because the extent of exposure of a particular silver halide particle almost exclusively determines the amount of dye released from that dye releasing compound which is present in the same coacervate particles (packet) as the silver halide. The use of packet emulsions therefore enables a blue-sensitive, a green-sensitive and a red-sensitive silver halide emulsion, optionally together with additional, substantially light-insensitive silver salts and the spectrally associated dye releasing compounds to be accommodated in the same layer of binder without any risk of serious colour falsification.

In addition to the constituents already mentioned, the colour photographic recording material used for the process according to the invention may contain further constituents and auxiliary substances which may be required, for example, for carrying out the heat treatment and colour transfer. These additional constituents or auxiliary substances may be contained in a light-sensitive layer or in a light-insensitive layer or they may be partly or completely contained in the image receptor layer used according to the invention.

Such auxiliary substances may be, for example, auxiliary developers, which generally have developing properties for the exposed silver halide. In the present case, they primarily promote the reactions taking place between the exposed silver salt (=silver salt in the presence of exposed silver halide) and the reducing agent. If an oxidizable dye releasing compound is used, the said reducing agent is identical to this dye releasing compound whereas if a reducible dye releasing compound is used, the reducing agent reacts with the dye releasing compound. Since these reactions consist mainly in a transfer of electrons, the auxiliary developers are also referred to as electron transfer agents (ETA). Hydroquinone, pyrocatechol, pyrogallol, hydroxylamine, ascorbic acid, 1-phenyl-3-pyrazolinone and derivatives of these compounds are examples of suitable auxiliary developers. Since the auxiliary developers exert a catalytic function, they need not be present in stoichiometric quantities. It is generally sufficient if they are present in quantities of up to ½ mol per mol of dye releasing compound in the layer. They may be incorporated in the layer, for example, from solutions in water-soluble solvents or in the form of aqueous dispersions obtained with the aid of oil formers.

Other auxiliary substances include, for example, basic substances or compounds which are capable of providing basic substances under the influence of heat treatment. Examples of such substances include sodium hydroxide, potassium hydroxide, calcium hydroxide, sodium carbonate, sodium acetate and organic bases, in particular amines such as trialkylamines, hydroxyalkylamines, piperidine, morpholine, dialkylaniline, p-toluidine, 2-picoline, guanidine and salts thereof, in particular salts with aliphatic carboxylic acids. The presence of the basic substances provides a suitable medium in the light-sensitive layer and adjacent layers during the heat treatment to ensure release of the diffusible dyes from the dye releasing compounds and their transfer to the image receptor sheet.

Examples of other auxiliary substances include the so-called thermal solvents or thermal development and diffusion-promoting substances described, for example, in DE-A-No. 3 215 485, EP-A- No. 0 122 512 and German patent application No. P 35 23 361.3. These are non-hydrolysable organic compounds which are liquid at the temperature of heat development and form a suitable medium for development and diffusion processes.

In the process according to the invention, a separate image receptor sheet is used. The most important component of this sheet is an image receptor layer capable of absorbing diffusible dyes and arranged on a transparent or opaque layer support.

In the process according to the invention, therefore, the image receptor layer is not arranged on the same layer support as the colour photographic recording material. The image receptor layer consists mainly of a binder containing the mordant for fixing the diffusible dyes released from the non-diffusible dye releasing compounds. The mordants used for anionic dyes are preferably long chained quaternary ammonium or phosphonium compounds, e.g. those described in U.S. patent application Ser. No. 3,271,147 and U.S. patent application Ser. No. 3,271,148.

Certain metal salts and their hydroxides which form sparingly soluble compounds with the acid dyes may also be used. Polymeric mordants such as those described in DE-A-No. 2 315 304, DE-A-No. 2 631 521 or DE-A-No. 2 941 818 are also suitable. The dye mordants in the mordant layer are dispersed in one of the usual hydrophilic binders, e.g. in gelatine, polyvinyl pyrrolidone or partially or completely hydrolysed cellulose esters. Some binders are, of course, capable of functioning as mordants, e.g. polymers of nitrogen-containing, optionally quaternary bases such as N-methyl-4-vinylpyridine, 4-vinylpyridine or 1-vinyl imidazole, for example as described in U.S. patent application Ser. No. 2,484,430. Other suitable mordanting binders include, for example, the guanylhydrazone derivatives of alkyl vinyl ketone polymers as described e.g. in U.S. patent application Ser. No. 2,882,156 and the guanylhydrazone derivatives of acyl styrene polymers as described e.g. in DE-A-No.2 009 498 although the last mentioned mordanting binders would normally be used in combination with other binders, such as gelatine.

The above mentioned image receptor layer may have a structured arrangement of layers as described, for example, in DE-A-No. 3 018 644 or DE-A-No. 3 345 070, and it may contain a mixture of different mordants as described, for example, in DE-A-No. 3 342 629. Furthermore, the above mentioned image receptor layer or a layer of binder adjacent therefore may contain metal ions or metal complexes as metallizing agents for complex-forming dyes, as described, for example, in DE-A-No. 2 740 719, U.S. patent application Ser. No. 4,282,305, DE-A-No. 3 105 777, DE-A-No. 3 132 333, DE-A-No. 3 202 127, DE-A-No. 3 220 435 and EP-A-No. 0 009 411.

The heat development process according to the invention is characterised in that either the photothermographic recording material used or the image receptor sheet or both contain an alkali metal alginate in a surface contact layer. The surface contact layer is a layer which by virtue of its composition, its properties, especially its mechanical properties, and not least its specific arrangement in the image receptor layer or in the photographic recording material is capable of exerting an important influence on the contact established between the two layers. The surface contact layer is generally the outermost or one of the outermost layers of the sheet material and is generally arranged above the other essential layers in the given material, However, it need not necessarily be the outermost layer but may be covered, for example, by a gelatine layer which is free from alginate and contains a hardener for the layer combination of the given sheet material.

It is advantageous, for example, to use an image receptor sheet according to the invention which carries an image receptor layer on an opaque or transparent layer support and, above this receptor layer, a surface contact layer containing alginate. A comparatively thin layer of binder may be arranged above this surface contact layer for the purpose of hardening the laminate of the image receptor sheet. This uppermost layer of binder which is free from alginate may, however, be dispensed with, especially if the surface contact layer containing alginate contains a hardener for the laminate.

The surface contact layer contains an alkali metal alginate preferably dispersed in a hydrophilic binder. The usual photographic layer binders may be used, preferably gelatine. Surface contact layers in which the proportion by weight of sodium alginate to gelatine is in the region of 1:4 to 4:1, preferably from 2:3 to 3:2, have been found to be very suitable.

The image receptor sheet according to the present invention may also contain other additives, optionally in additional layers, e.g. dye stabilizing substances or opacifying agents. Thus, for example, one layer may contain a white pigment, especially if the layer support is transparent. Such a layer situated between the layer support and the image receptor layer or above the image receptor layer generally serves as a white background for the colour transfer image produced. This layer which forms a white image background preferably has a layer containing carbon black arranged behind it (with reference to the direction of viewing) to prevent light passing through the back of the image due to transparency. The image receptor sheet may also contain one of the above mentioned auxiliary substances in one of its layers, e.g. an auxiliary developer, a base donor or a so-called development and diffusion promoting agent.

According to the invention. development of the imagewise exposed colour photographic recording material is initiated by subjecting it to a heat treatment, optionally in contact with the image receptor sheet according to the invention, to heat the layers to an elevated temperature, e.g. in the region of 80° to 250° C., for about 0.5 to 300 seconds. This treatment creates suitable conditions for the development processes, including dye diffusion, in the layers of the recording material, generally without the aid of a liquid medium, e.g. in the form of a developer bath. Development releases diffusible dyes imagewise from the dye releasing compounds and these dyes are transferred to the image receptor layer of the image receptor sheet. The process may be arranged so that imagewise development of silver, release of dye and dye transfer take place synchronously in a single step process.

Production of the colour image may also be carried out according to the invention as a two-step development process, in which silver halide development and release of dye are carried out in a first step by heating the photothermographic recording material in the absence of the image receptor sheet according to the invention, and transfer of the colour image from the photographic recording material to the image receptor sheet which has been brought into contact with it is carried out in a second step, e.g. by heating to a temperature in the region of 50° to 150° C., preferably 70° to 90° C., in which case diffusion auxiliaries (solvents) may be applied externally prior to lamination of the recording material with the image receptor sheet, e.g. by briefly leaving the recording material or the image receptor sheet or both to swell in water.

The image receptor sheet can be smoothly separated from the recording material after colour transfer has taken place. The surface contact layer according to the invention proves to be very useful for this separation. Brilliant colour images with smooth surfaces and completely free from patches are obtained. Whereas the layers of a laminated sheet material tend to stick together when heated if the gelatine layers are free from alginate, and the surfaces are therefore liable to be damaged when forcibly separated, this does not arise in the present case.

EXAMPLE 1

Preparation of the silver salt emulsions

Emulsion 1

17.0 g of $AgNO_3$ dissolved in 200 ml of water heated to 45° C. were added within 2 minutes with stirring to a solution heated to 45° C. of 20.0 g of gelatine in 1000 ml of water containing 13.0 g of benzotriazole (BTA). Stirring was then continued for 5 minutes and the pH adjusted to 5.0 with 5% $Na_2CO_3$ solution. A flocculate was produced by the addition of 20 ml of a 10% polystyrene sulphonic acid solution, cooling to 25° C. and addition of 10% sulphuric acid (up to pH 3.0 to 3.5) and washed three times with 1000 ml portions of water. The flocculate was heated to 45° C. and adjusted to pH 6.0 with 5% $Na_2CO_3$ solution, 5 ml of a 1% aqueous phenol solution were added, and the reaction mixture was made up to a final weight of 435 g by the addition of water.

Emulsion 2

34.0 g of $AgNO_3$ dissolved in 200 ml of water were added in the course of 10 minutes to a solution heated to 50° C. of 40.0 g of gelatine, 23.7 g of KBr and 1.66 g of KI. Stirring was then continued for 20 minutes at 50° C. and the reaction mixture cooled to 35° C. 40 ml of a 10% polystyrene sulphonic acid solution were added dropwise and the mixture cooled to 20° C. A flocculate was produced by the addition of 10% sulphuric acid (up to pH 3.0 to 3.5) and washed three times with 700 ml portions of water. The reaction mixture was then heated to 40° C. and adjusted to pH 6.0 with 10% sodium hydroxide solution. Final weight 1171 g.

Portions of emulsion 2 (crude emulsion) were spectrally sensitized by melting at 40° C., adding, per mol of Ag, $4\times10^{-4}$ mol of red sensitizer, $4\times10^{-4}$ mol of green sensitizer or $8\times10^{-4}$ mol of blue sensitizer, in each case in methanolic solution or suspension, and leaving the mixture to digest in a closed vessel for about 70 minutes.

The following spectral sensitizers were used:

Red sensitizer:

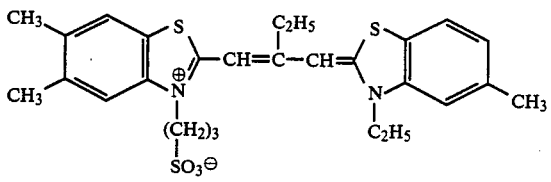

Green sensitizer:

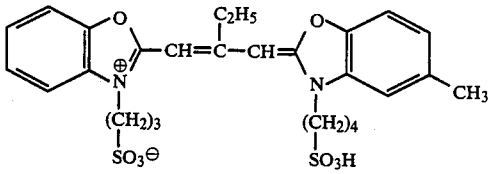

Blue sensitizer:

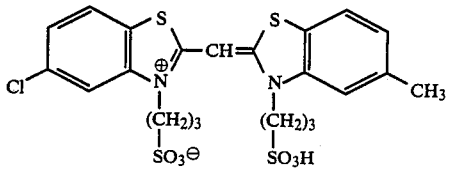

EXAMPLE 2

Preparation of dispersions

Dispersion 1 (Dye releasing compound C-1)

50 g of dye releasing compound C-1 were dissolved with 50 g of 20% aqueous $KHCO_3$ solution in a mixture of 50 g of tricresyl phosphate, 50 g of tetrahydrofuran and 200 ml of ethyl acetate and dispersed in the presence of 2.6 g of sodium dodecylbenzene sulphonate in 330 g of 10% aqueous gelatine solution, and the auxiliary solvents were then removed with depressurized steam in a vacuum apparatus. Yield: 1060 g of Dispersion 1.

Dispersion 2 (Dye releasing compound M-1)

50 g of dye releasing compound M-1 were dissolved in 25 g of diethyl laurylamide and 150 ml of ethyl acetate and then treated in the same manner as Dispersion 1. Yield: 834 g of Dispersion 2.

Dispersion 3 (Dye releasing compound Y-1)

50 g of dye releasing compound Y-1 were dissolved in 25 g of diethyl laurylamide and 150 ml of ethyl acetate and then treated in the same manner as Dispersion 1. Yield: 821 g of Dispersion 3.

Dispersion 4 (Auxiliary developer precursor compound)

62 g of auxiliary developer precursor compound were dissolved in 120 g of diethyl laurylamide and 150 ml of ethyl acetate and dispersed in 612 g of 10% aqueous gelatine solution in the presence of 3.5 g of sodium dodecyl benzene sulphonate. The auxiliary solvent was then removed by the same method as that used for Dispersion 1. Yield: 997 g of Dispersion 4.

The following compounds were used:

1. A gelatine layer containing 1.25 g of carbon black and 1.5 g of gelatine.
2. A light reflecting layer containing 13 g of $TiO_2$ and 1.3 g of gelatine.
3. A mordant layer containing 2 g of a polyurethane mordant of 4,4'-diphenylmethane diisocyanate and N-ethyldiethanolamine quaternized with epichlorohydrin according to DE-A-No. 2 631 521, Example 1, and 2 g of gelatine.
4. A layer of 0.6 g of gelatine and 0.6 g of sodium alginate to which a hardener has been added.

Dye releasing compound C-1

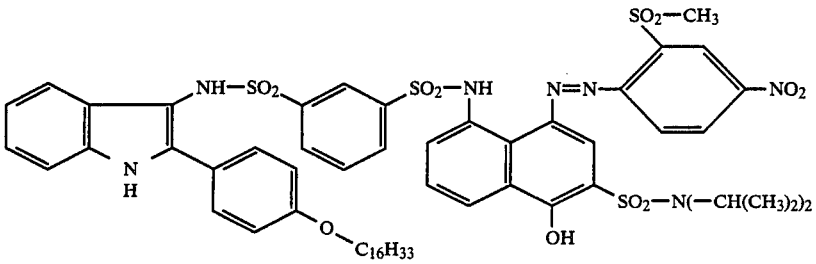

Dye releasing compound M-1

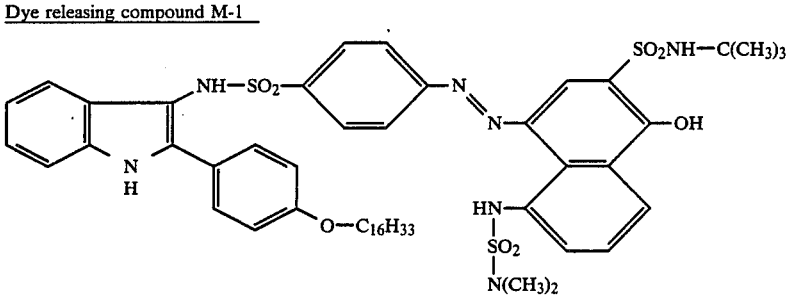

Dye releasing compound Y-1

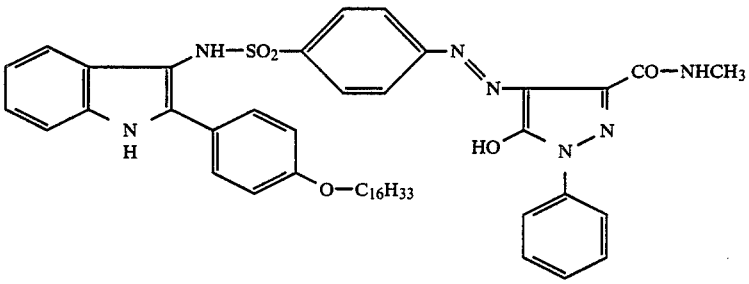

Auxiliary developer precursor compound

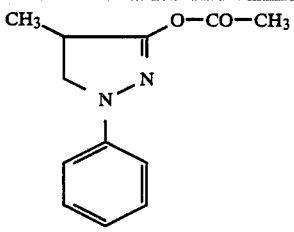

EXAMPLE 3

Image receptor part A

The image receptor part of a photographic recording material for the dye diffusion transfer process was prepared by applying the following layers in succession to a transparent layer support of polyethylene terephthalate. (The quantities refer in each case to 1 $m^2$):

Image receptor parts B to F (according to the invention) and V (Comparison) were prepared as described below.

Image receptor part B

Preparation same as for image receptor part A but with an additional layer 5 of 0.5 g of gelatine to which hardener had been added (instead of layer 4).

Image receptor part C

Preparation same as for image receptor part A but with layers 1, 2 and 3 arranged in reverse sequence.

Image receptor part D

Preparation as for image receptor part B but with layers 1,2 and 3 in reverse sequence.

Image receptor part E

Preparation by application of layers 3 and 4 of image receptor part A (no layers 1 and 2) to a layer support of baryta paper.

Image receptor part F

Preparation by application of layers 3 to 5 image receptor part B (no layers 1 and 2) to a layer support of baryta paper, Image receptor part V (not according to the invention)

Preparation same as for image receptor part B but without layers 1,2 and 4 (only layers 3 and 5).

EXAMPLE 4

Light-sensitive parts of colour photographic recording materials for the dye diffusion transfer process were prepared as follows:

Sample 1

24.0 g of a 2.5% aqueous solution of hydroxyethyl cellulose were homogenized with 108 ml of water and 8 ml of a 4% aqueous solution of solution of Triton[®]×100.

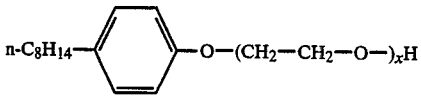

x = 9 to 10

Triton×100
Manufacturer: Rohm and Haas Company, Philadelphia 6.7 g of Dispersion 4, 18.5 g of Dispersion 1 (Dye releasing compound C-1). 45.6 g of Emulsion 1 and 32.0 g of Emulsion 2. red-sensitized, were then added and the mixture melted. 3.2 g of guanidine trichloroacetate in 30 ml of water were then slowly added and lastly 44.0 g of the 30% polyurethane solution described below were added, whereupon the whole mixture was homogenized. The finished casting solution was applied to a layer support of polyethylene terephthalate to form a 100 μm thick wet layer and dried at 35° C. This layer was covered with a 1% aqueous gelatine solution containing a hardener (wet layer thickness 40 μm) and dried.

The polyurethane used was a 30% aqueous dispersion free from wetting agent of an anionic polyester polyurethane obtained from 84.1% of a polyester of adipic acid, 1,6-hexanediol and neopentyl glycol (molar ratio 30:22:12), OH number 66.6, molecular weight 1600 to 1700, 13.1% hexamethylene diisocyanate and 2.7% N-aminoethyltaurine. $SO_3Na$ group content: 1.93%.

Sample 2

Method of preparation the same as for Sample 1 but using 32.0 g of Emulsion 2, green sensitized, and 17.2 g of Dispersion 2 (dye releasing compound M-1).

Sample 3

Method of preparation same as for Sample 1 but using 32.0 g of Emulsion 2, blue sensitized, and 15.3 g of Dispersion 4 (dye releasing compound Y-1).

EXAMPLE 5

The samples prepared according to Example 4 were exposed to the light of a tungsten lamp (1000 1×, 5 s), Samples 1 and 2 being exposed behind a transparent yellow filter with a density of 1.25. The samples were then heated dry to 110° C. for 60 seconds for development. The samples were then left to swell in water for 10 seconds and laminated to the image receptor sheets (Example 3) which had also been left to swell in water for 30 to 60 seconds, and the laminates were heated to 75° C. on a controlled heating bench for 2 to 3 minutes and then separated and immediately dried. Brilliant, sharp colour images completely free from patches were obtained on image receptor sheets A-F whereas in the reference image receptor sheet V strong colour patchiness is reproducibly produced in the process of colour transfer, presumably due to poor laminating properties which seriously impede dye diffusion in the areas where patchiness occurs. The surface contact layer according to the invention proves to be very useful for avoiding such faults. In addition, it may be seen from the data in Table 1 that the surface contact layer according to the invention has virtually no effect on the diffusion of the different chromophores. Moreover, when the image receptor materials according to the invention are used, the sticking which generally occurs when laminated sheet material not containing alginate in the gelatine layers are heated is found to be avoided. Perfect surface properties are obtained when the surfaces are separated immediately after processing.

TABLE 1

| Image receptor part (Example 3) | Light sensitive sample (Example 4) | Transfer time [min] | Colour density $D_{min}$ | Colour density $D_{max}$ | Formation of patches |
|---|---|---|---|---|---|
| A | 1 | 2 | 0.22 | 1.63 | none |
| B | 1 | 2 | 0.21 | 1.61 | " |
| C | 1 | 3 | 0.20 | 1.56 | " |
| D | 1 | 3 | 0.19 | 1.53 | " |
| E | 1 | 2 | 0.22 | 1.67 | " |
| F | 1 | 2 | 0.20 | 1.65 | " |
| V | 1 | 2 | 0.22 | 1.69 | severe |
| A | 2 | 2 | 0.23 | 1.78 | none |
| B | 2 | 2 | 0.21 | 1.75 | " |
| C | 2 | 3 | 0.19 | 1.69 | " |
| D | 2 | 3 | 0.18 | 1.67 | " |
| E | 2 | 2 | 0.23 | 1.79 | " |

TABLE 1-continued

| Image receptor part (Example 3) | Light sensitive sample (Example 4) | Transfer time [min] | Colour density $D_{min}$ | Colour density $D_{max}$ | Formation of patches |
|---|---|---|---|---|---|
| F | 2 | 2 | 0.22 | 1.77 | " |
| V | 2 | 2 | 0.23 | 1.81 | severe |
| A | 3 | 2 | 0.19 | 1.52 | none |
| B | 3 | 2 | 0.19 | 1.47 | " |
| C | 3 | 3 | 0.18 | 1.48 | " |
| D | 3 | 3 | 0.17 | 1.43 | " |
| E | 3 | 2 | 0.21 | 1.49 | " |
| F | 3 | 2 | 0.20 | 1.46 | " |
| V | 3 | 2 | 0.19 | 1.47 | severe |

We claim:

1. Heat development process for the production of colour images in which an imagewise exposed colour photographic recording material having at least one layer of binder arranged on a layer support and containing light-sensitive silver halide, optionally in combination with a substantially light-insensitive silver salt, and at least one non-diffusible, colour providing compound capable of releasing a diffusible dye as a result of development is developed by heat treatment, and in which the dye relesed imagewise from the non-diffusible colour providing compound is transferred by heat treatment to a surface of a separate image receptor sheet which is brought with its active side into surface contact with the recording material and has a receptor layer which is arranged on a layer support and is capable of absorbing diffusible dyes, whereupon the image receptor sheet is separated from the recording material, characterised in that either the light-sensitive recording material or the image receptor sheet or both contain an alkali metal alginate in a surface contact layer for improving contact between the recording material and the image receptor sheet.

2. Heat development process as claimed in claim 1, wherein either the recording material or the image receptor sheet or both contain an upper layer containing sodium alginate dispersed in a hydrophilic binder.

3. Heat development process as claimed in claim 2, wherein said hydrophilic binder is gelatin.

4. An image receplor sheet in which a layer of binder (image receptor layer) capable of absorbing diffusible dyes is arranged on a layer support, characterised in that a layer containing sodium alginate and gelatine in proportions by weight in the range of 1:4 to 4:1 is arranged above the dye absorbent layer of binder.

5. Image receptor sheet as claimed in claim 4, wherein the proportion by weight of sodium alginate to gelatine is in the range of 2:3 to 3:2.

6. Heat development process as claimed in claim 3, wherein the proportion by weight of sodium alginate to gelatine in said upper layer is in the range of 1:4 to 4:1.

* * * * *